US008820812B2

(12) United States Patent
Menna

(10) Patent No.: US 8,820,812 B2
(45) Date of Patent: Sep. 2, 2014

(54) AMBULANCE VEHICLE FOR TRANSPORT OF PATIENTS, INJURED PERSONS AND THE LIKE

(75) Inventor: Ezio Menna, Sala Baganza (IT)

(73) Assignee: Stem S.R.L., Medesano (Parma) (IT)

( * ) Notice: Subject to any disclaimer, the term of this patent is extended or adjusted under 35 U.S.C. 154(b) by 0 days.

(21) Appl. No.: 13/814,215

(22) PCT Filed: Jul. 22, 2011

(86) PCT No.: PCT/IB2011/001721
§ 371 (c)(1),
(2), (4) Date: Feb. 4, 2013

(87) PCT Pub. No.: WO2012/017283
PCT Pub. Date: Feb. 9, 2012

(65) Prior Publication Data

US 2013/0127198 A1 May 23, 2013

(30) Foreign Application Priority Data

Aug. 6, 2010 (IT) ..... RE2010A0064

(51) Int. Cl.
*A61G 3/02* (2006.01)
*A61G 3/06* (2006.01)
*A61G 3/00* (2006.01)

(52) U.S. Cl.
CPC ..... *A61G 3/0272* (2013.01); *A61G 3/0218* (2013.01); *A61G 3/006* (2013.01); *A61G 3/0245* (2013.01); *A61G 3/029* (2013.01); *Y10S 414/134* (2013.01)
USPC ..... 296/19; 414/921

(58) Field of Classification Search
CPC ..... A61G 3/02; A61G 3/006; A61G 3/029; A61G 3/0218; A61G 3/0236; A61G 3/0245; A61G 3/0272
USPC ..... 296/19, 20; 248/429, 430; 5/625, 626; 414/467–559, 921
See application file for complete search history.

(56) References Cited

U.S. PATENT DOCUMENTS

| | | | | |
|---|---|---|---|---|
| 2,387,186 | A | 10/1945 | Schofield | |
| 2,398,894 | A * | 4/1946 | Schofield | 454/138 |
| 2,456,024 | A * | 12/1948 | Schofield | 296/19 |
| 2,650,725 | A * | 9/1953 | Hoyer et al. | 414/549 |
| 3,656,637 | A * | 4/1972 | Lynn et al. | 414/542 |
| 7,478,855 | B2 | 1/2009 | Lambarth et al. | |
| 2008/0023976 | A1 * | 1/2008 | Myers et al. | 296/19 |
| 2011/0076121 | A1 * | 3/2011 | Gaghis | 414/471 |

* cited by examiner

*Primary Examiner* — Glenn Dayoan
*Assistant Examiner* — Jason S Daniels
(74) *Attorney, Agent, or Firm* — Volpe and Koenig, P.C.

(57) ABSTRACT

A vehicle for transport of injured persons, patients and the like, which comprises: a sanitary compartment including a treading plane raised with respect to a ground surface, and an upper zone, opposite the treading plane; a lifting device for loading and unloading a stretcher located between a first extracted position in which the stretcher is resting on the ground and a second housed position in which it is arranged internally of a sanitary compartment; in which the lifting device comprises: collecting means configured to pick up the stretcher and being mobile between a lowered configuration below the level of the treading plane and a raised configuration; movement means of the collecting means, internally associable to the sanitary compartment at the upper zone for moving the stretcher between the first position and the second position and being destined to maintain the collected stretcher suspended above the treading plane.

12 Claims, 9 Drawing Sheets

AMBULANCE VEHICLE FOR TRANSPORT OF PATIENTS, INJURED PERSONS AND THE LIKE

TECHNICAL FIELD

The invention relates to an ambulance vehicle for transport of the injured, the sick or disabled.

An advantageous application relates to a military ambulance vehicle for first aid or emergency situations, destined to house an injured person in a sanitised compartment, for example lying on a stretcher, and transport the person to a hospital.

Generally, the invention relates to any type of ambulance vehicle, including for civil use.

PRIOR ART

Ambulances of known type, destined to collect injured persons, are such as to transport the injured person, lying on a stretcher in turn positioned internally of the sanitary compartment, directly onto the treading plane or by possible interposing of planes or guides situated on the treading plane, which can facilitate the introduction and positioning of the stretcher internally of the sanitary compartment.

Also known, with the aim of facilitating the operations of loading and unloading the stretcher into and out of the sanitary compartment, are automatic devices such as the ones described in U.S. Pat. No. 7,478,855, which describes a loading/unloading device especially for stretchers which is suitable for loading and/or unloading of a stretcher from at least a rest plane, defined by the ground, to at least a treading plane, defined by the loading plane of a transporter vehicle, such as an ambulance or the like.

The device comprises gripping means for a stretcher resting on the ground and drawing means along the longitudinal axis of the stretcher of the gripping means, which are fixed to the treading plane, for loading the stretcher onto the treading plane of the ambulance.

A further type of ambulance comprises the use of lifting devices of the stretcher which comprise a plane which is moved by linear actuators, such that the stretcher is arranged in proximity of the plane defined by the ground, such as to enable loading of the stretcher or the wheelchair or the like, onto the plane. Once received restingly on the lift plane the stretcher is raised, keeping it substantially horizontal, up to a level at which it is substantially coplanar to the plane defined by the bottom of the sanitary compartment of the ambulance.

With the plane in this configuration, the stretcher can be easily pushed internally of the sanitary compartment and be housed there resting on the treading plane.

Vehicles of known type, however, exhibit some drawbacks, among which is the fact that they do not take into consideration, nor do they alleviate, any eventual stresses the stretcher and therefore the patient lying on the stretcher might be subject to during the stages of transport internally of the sanitary compartment, i.e. the stages of transport of the patient on board the transporter vehicle.

This drawback is more greatly evident when the transporter vehicle, i.e. the ambulance, is a military vehicle which is liable to travel over terrain subject to external explosions, which might cause the plastic deformation of the body of the sanitary chamber in which the patient or the injured person picked up is housed.

Stresses due, for example, to bomb explosions such as land mines or the like deform the sanitary compartment, causing protrusions, especially of the bottom and the lateral walls, towards the inside thereof.

The walls, i.e. generally the bottom of the sanitary compartment and the lateral walls, when deformed, can impact against the stretcher housed internally of the sanitary compartment and thus cause injury to the patient.

Also known is patent no. U.S. Pat. No. 2,387,186, which describes an ambulance vehicle as defined in the preamble to independent claim no. 1.

Athough the above-cited patent describes a device destined to keep the stretcher suspended internally of the sanitary compartment of the vehicle, once loaded, for example, in order to optimise the space internally of the sanitary compartment and transport several patients at the same time, this device is not such as to be able to in any way facilitate the loading and unloading operations to and from the stretcher.

On the contrary, the plane in which the stretcher is to be loaded is always at a greater height than the loading plane (treading plane) of the sanitary compartment, which brings about considerable drawbacks for the specialised personnel in loading and unloading the stretcher in the sanitary compartment of the ambulance.

A task of the invention is to eliminate the above-cited drawbacks in vehicles for the transport of the sick, injured or the like, of known type by means of a vehicle for transport of injured persons which safeguards the patient lying on the loaded stretcher in all stages of his or her transport, from loading to unloading thereof, while at the same time facilitating the loading and unloading operations of the stretcher into the sanitary compartment of the ambulance.

An aim of the invention is, further, to enable housing of the stretcher and the patient arranged thereon in the sanitary compartment suspended with respect to the treading plane and in a zone of the treading plane which is particularly safe with regard to deformations that the sanitary compartment might be subject to.

Further, an aim of the invention is that the stretcher transported internally of the sanitary compartment can be accessible, for example with the aim of performing first-aid operations on the patient, on several sides of the stretcher including during the stage of transport of the patient.

In the ambit of the above technical objective, a further aim of the present invention is to present a simple structure which is relative easy to practically actuate, secure in use and effective in functioning, as well as having relatively contained costs.

These aims are attained by the characteristics of the invention as reported in the independent claim.

The dependent claims delineate preferred and/or especially advantageous aspects of the invention.

DISCLOSURE OF THE INVENTION

The invention relates to a vehicle for transport of the injured, patients and the like, comprising:

a sanitary compartment provided with a treading plane raised with respect to a ground surface, and an upper zone, opposite the treading plane;

a lifting device for loading and unloading a stretcher located between a first extracted position in which the stretcher is resting on the ground and a second housed position in which it is arranged internally of a sanitary compartment, comprising:

collecting means destined to pick up the stretcher;

movement means of the collecting means, internally associated to the sanitary compartment for moving the stretcher between the first position and the second position; wherein the movement means are suitable for maintaining the raised stretcher above the treading plane.

In the invention, the movement means are suitable for moving the collecting means between a lowered configuration, in which they are arranged at a lower height with respect to the height defined by the treading plane in order to collect the stretcher, and a raised configuration in which they are arranged at a greater height than the height defined by the treading plane in order to maintain it raised therefrom.

Thanks to this solution, the stretcher can be loaded without great effort by the specialised personnel, as the collecting means can be brought to the stretcher rested on the ground and, at the same time, once the stretcher is loaded internally of the sanitary compartment of the ambulance it is such as to remain suspended from the treading plane, with the above-evidenced advantages.

BRIEF DESCRIPTION OF THE DRAWINGS

Further characteristics and advantages of the invention will emerge from a reading of the following description, provided by way of non-limiting example with the aid of the figures illustrated in the accompanying figures of the drawings.

BEST MODE FOR CARRYING OUT THE INVENTION

Figure 1:
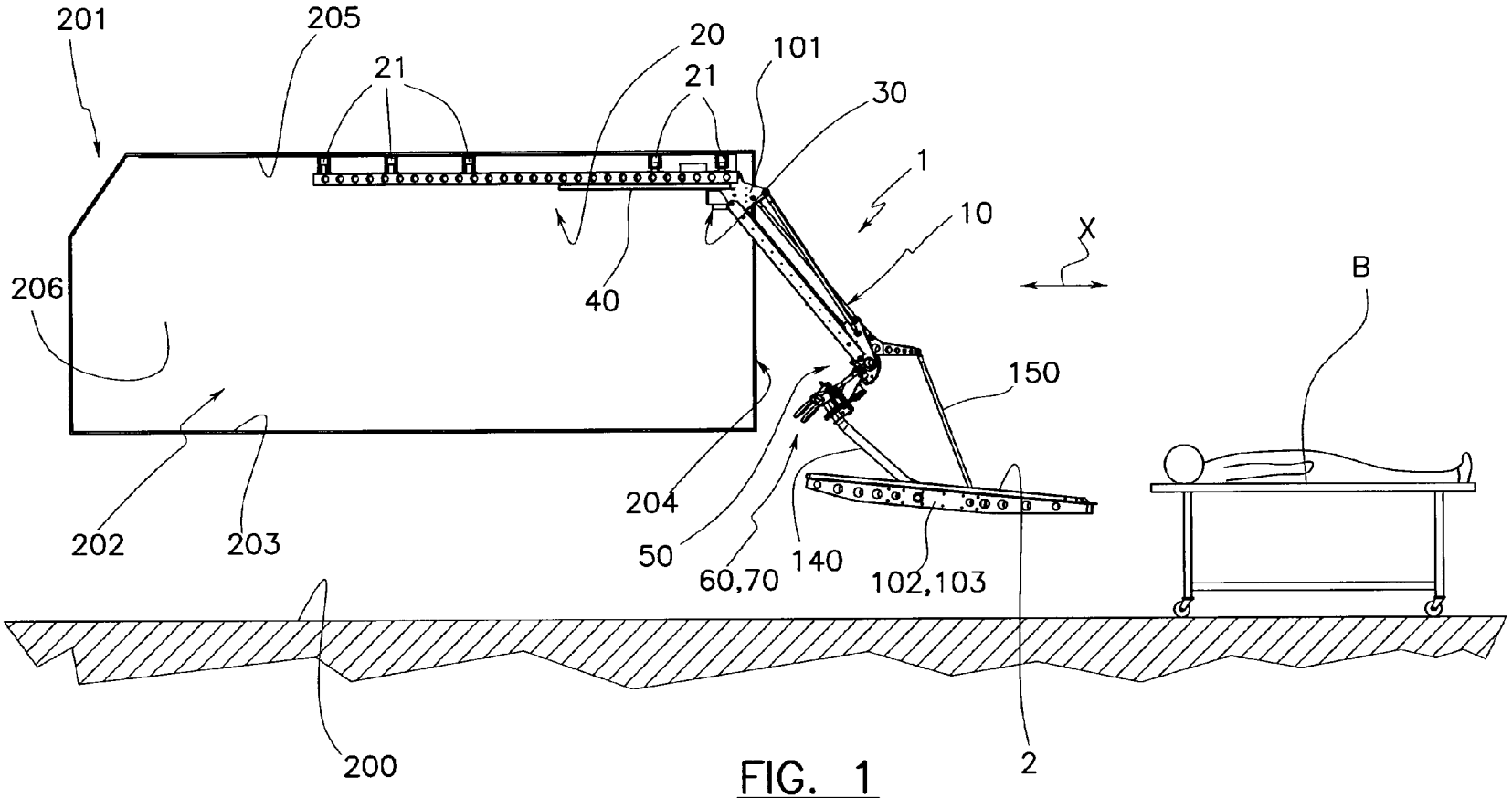
FIG. 1 is a lateral section view of a vehicle provided with a lifting device according to the invention, with collecting means in a lowered configuration for collecting a stretcher in the first position.
Figure 2:
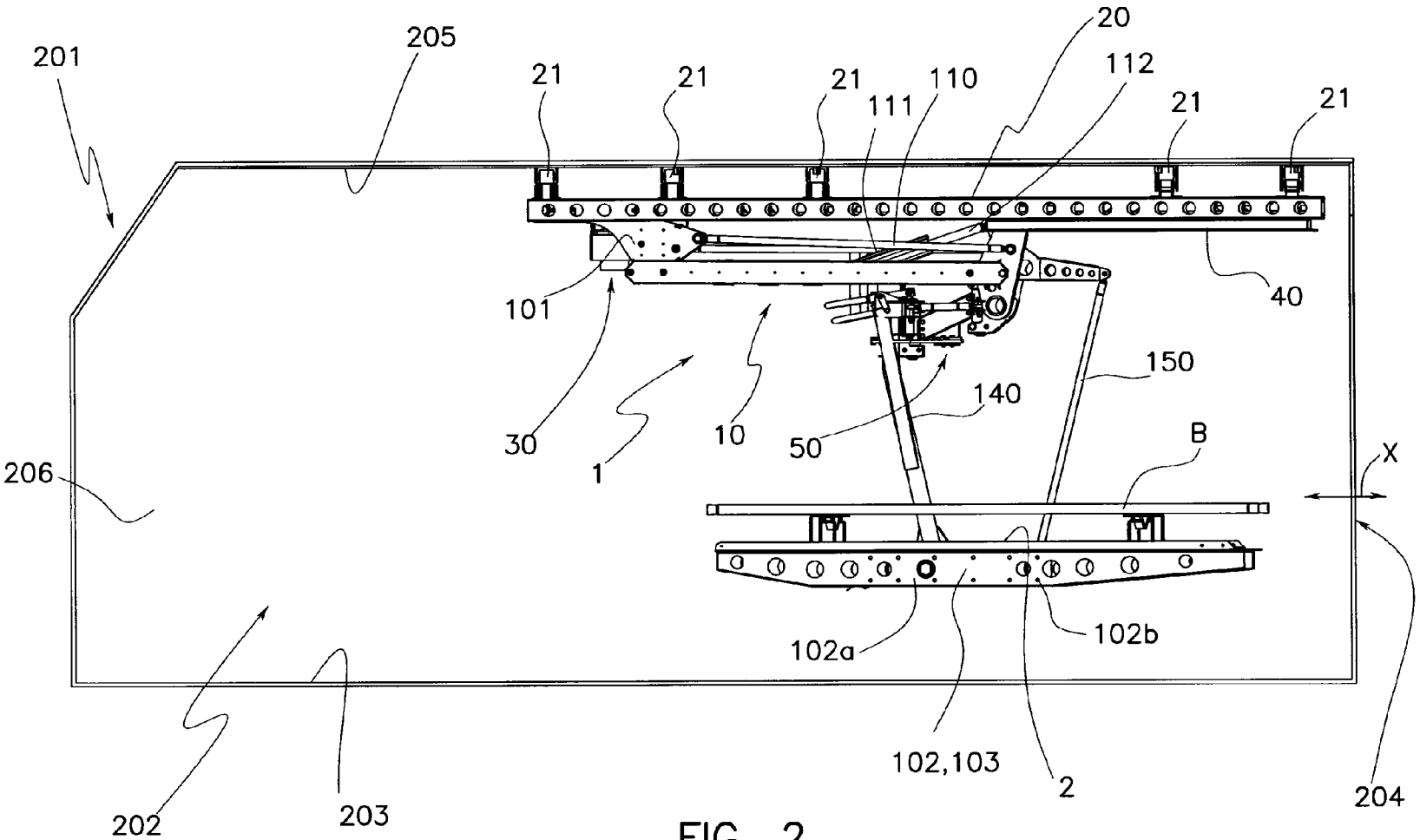
FIG. 2 is a lateral section view of the vehicle of FIG. 1 with the collecting means in a raised configuration for the arrangement of a stretcher in the second position.
Figure 3:
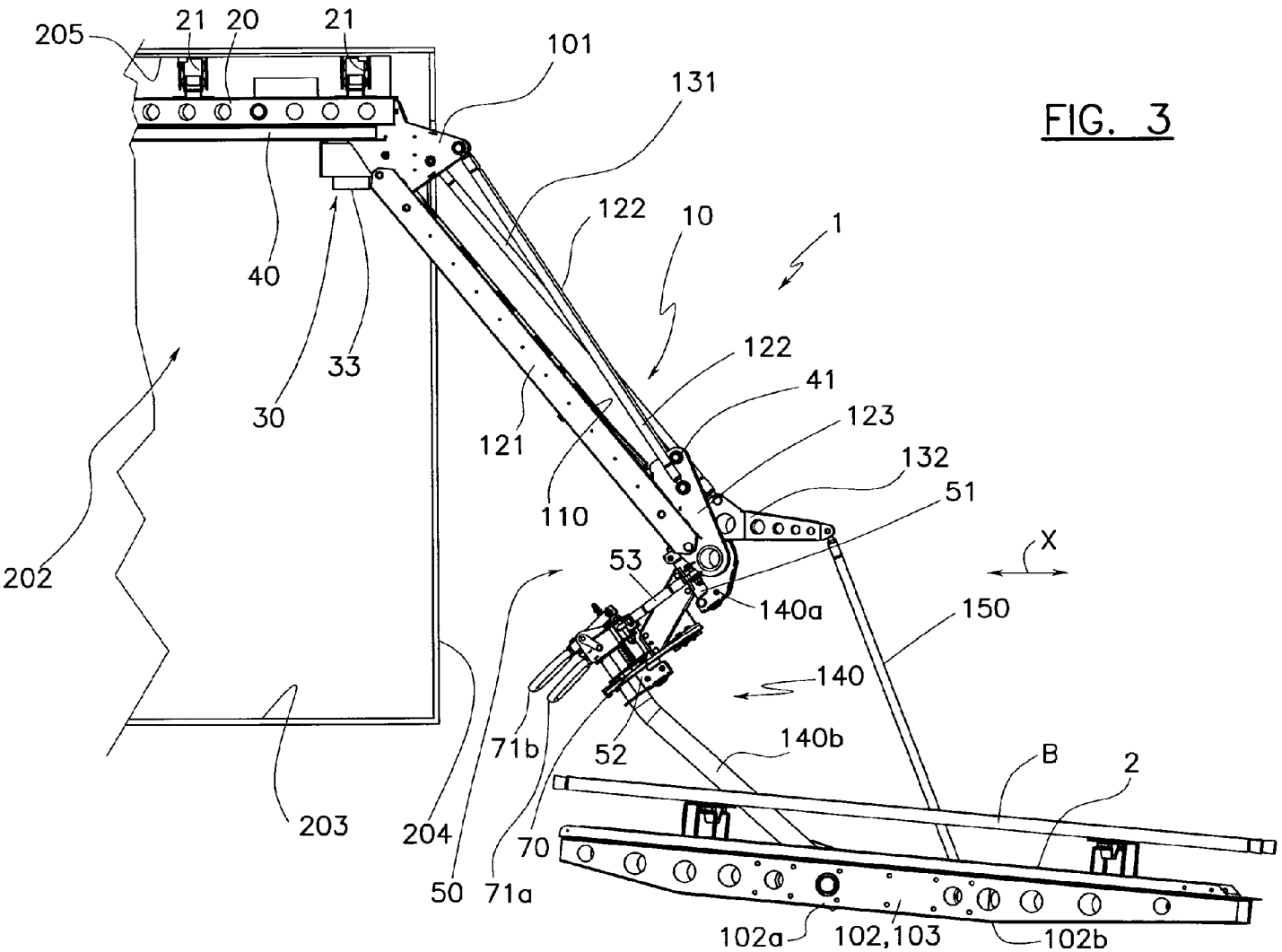
FIG. 3 is a view of a detail of the lifting device of FIG. 1, with the collecting means in the lowered configuration.
Figure 4:
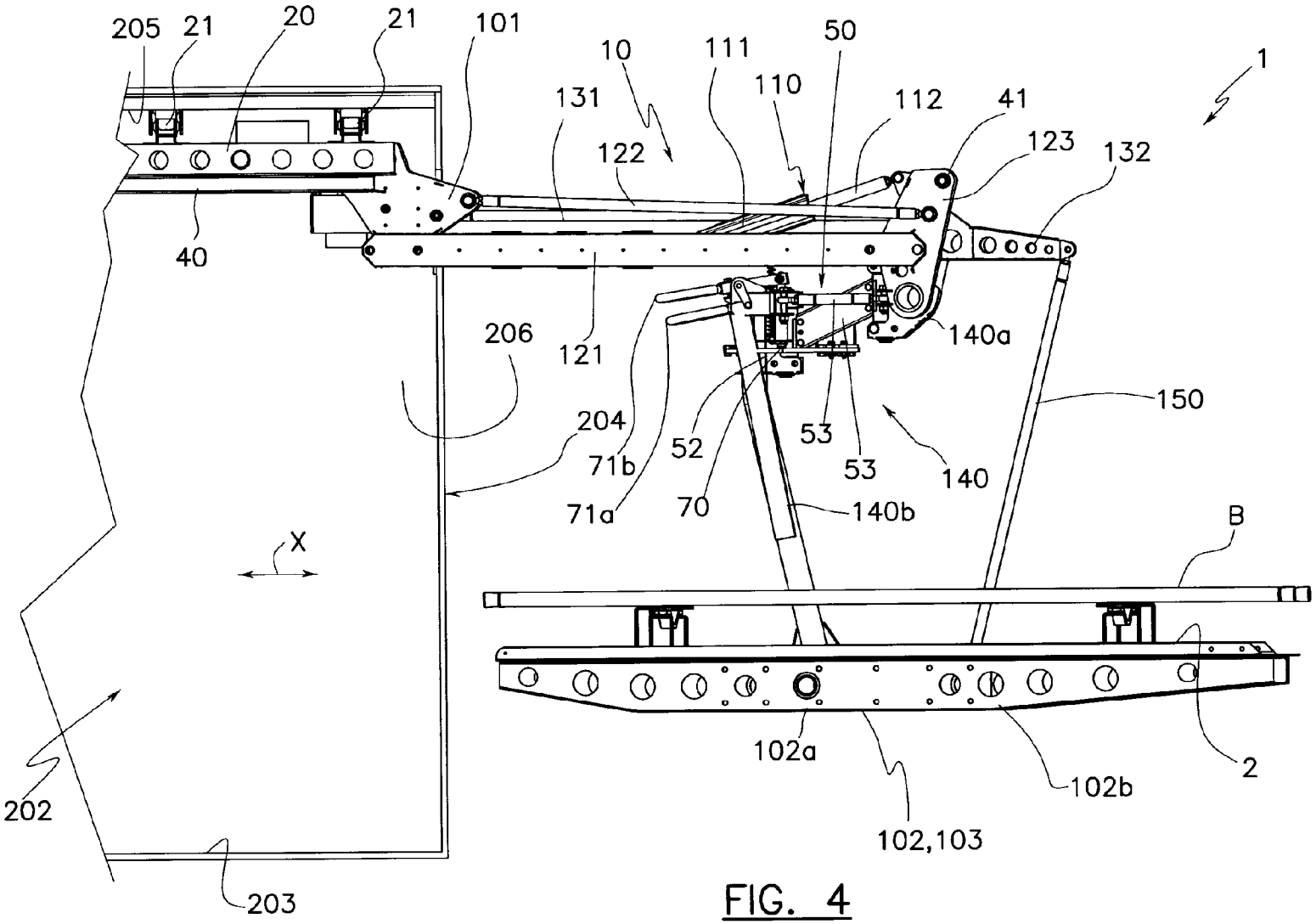
FIG. 4 is a view of a detail of the lifting device of FIG. 1, with the collecting means in a raised configuration.
Figure 5:
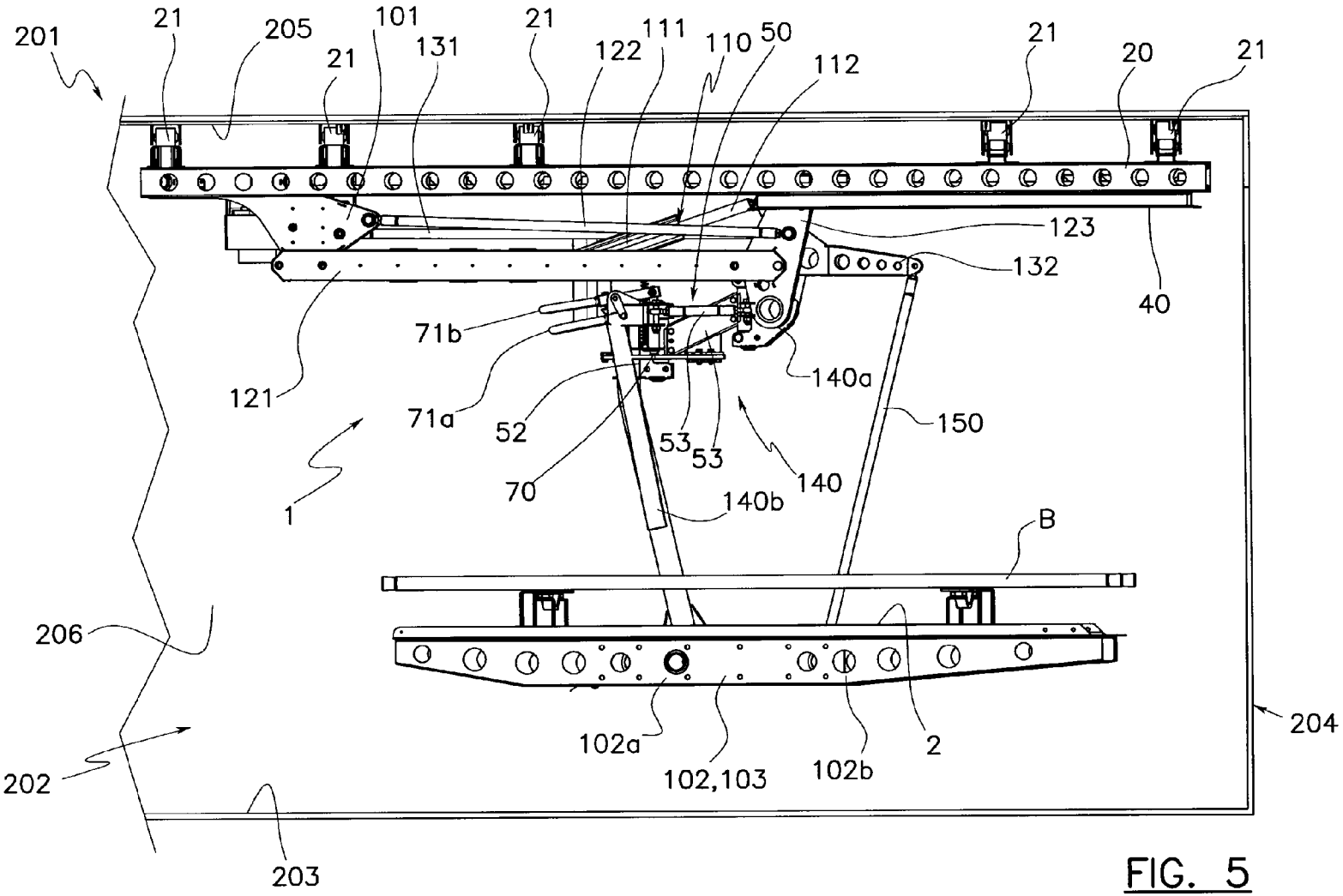
FIG. 5 is a view of a detail of the lifting device of FIG. 2.
Figure 6:
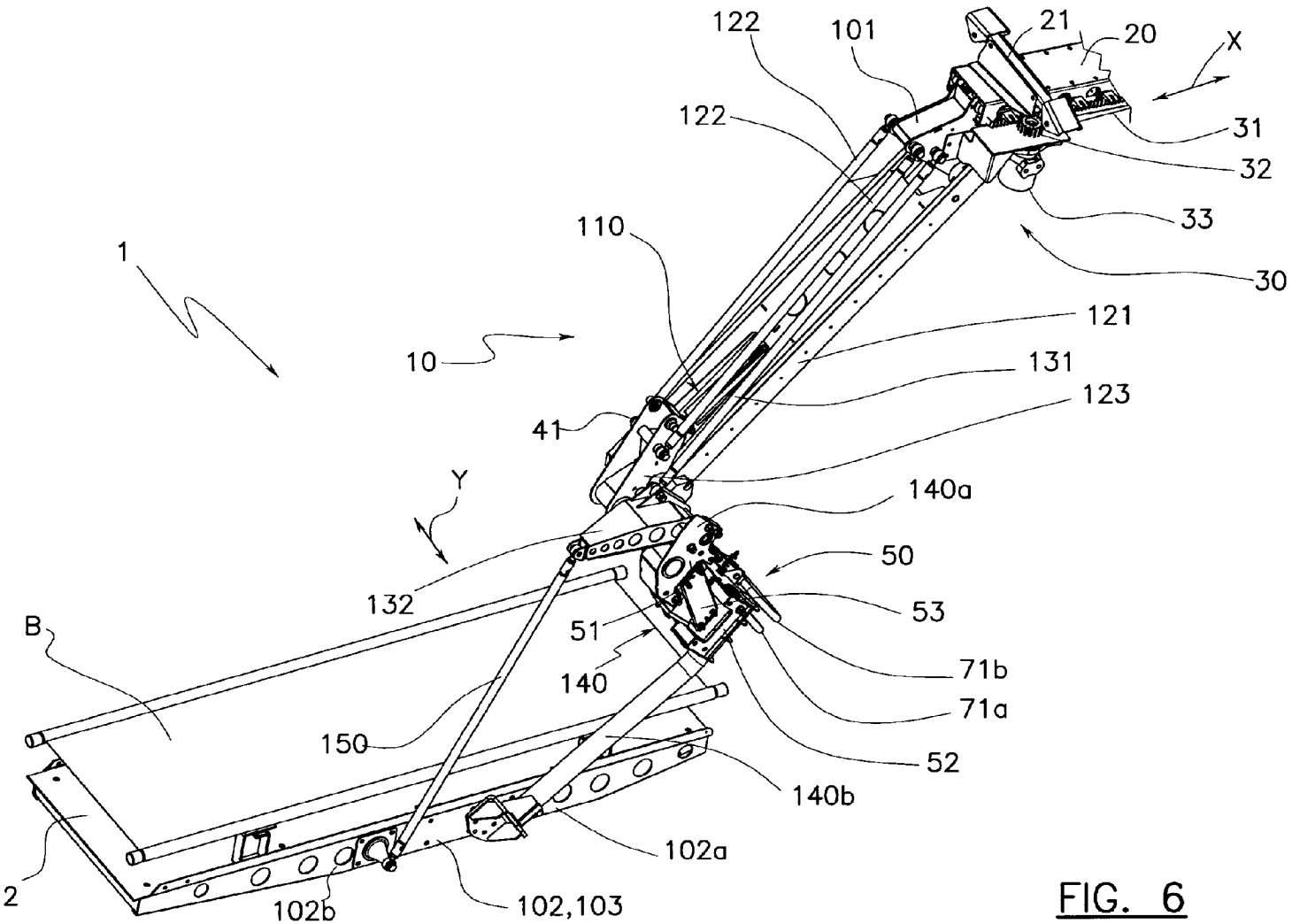
FIG. 6 is an axonometric rear view of the lifting device of FIG. 3.
Figure 7:
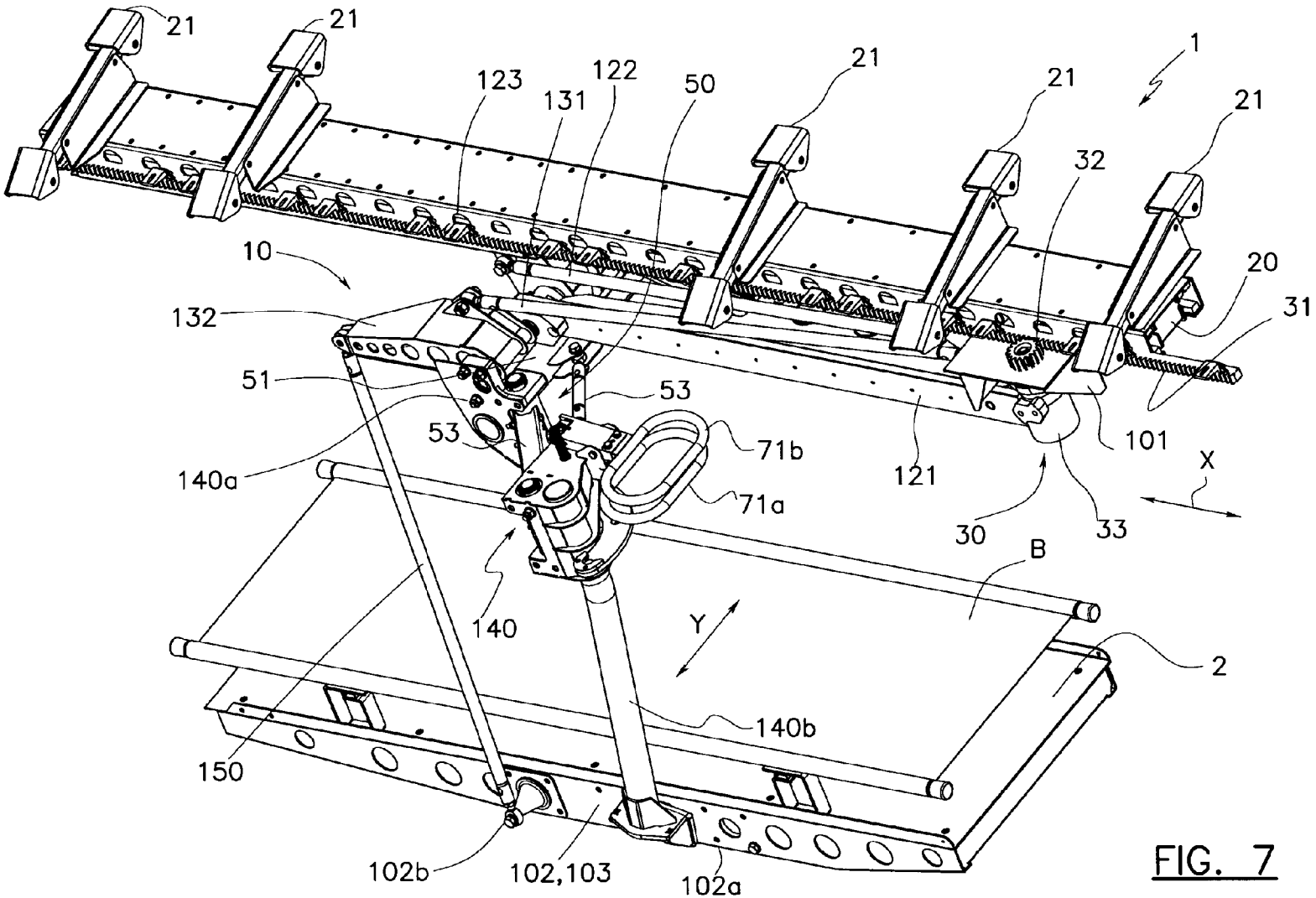
FIG. 7 is an axonometric rear view of the lifting device of FIG. 5.
Figure 8:
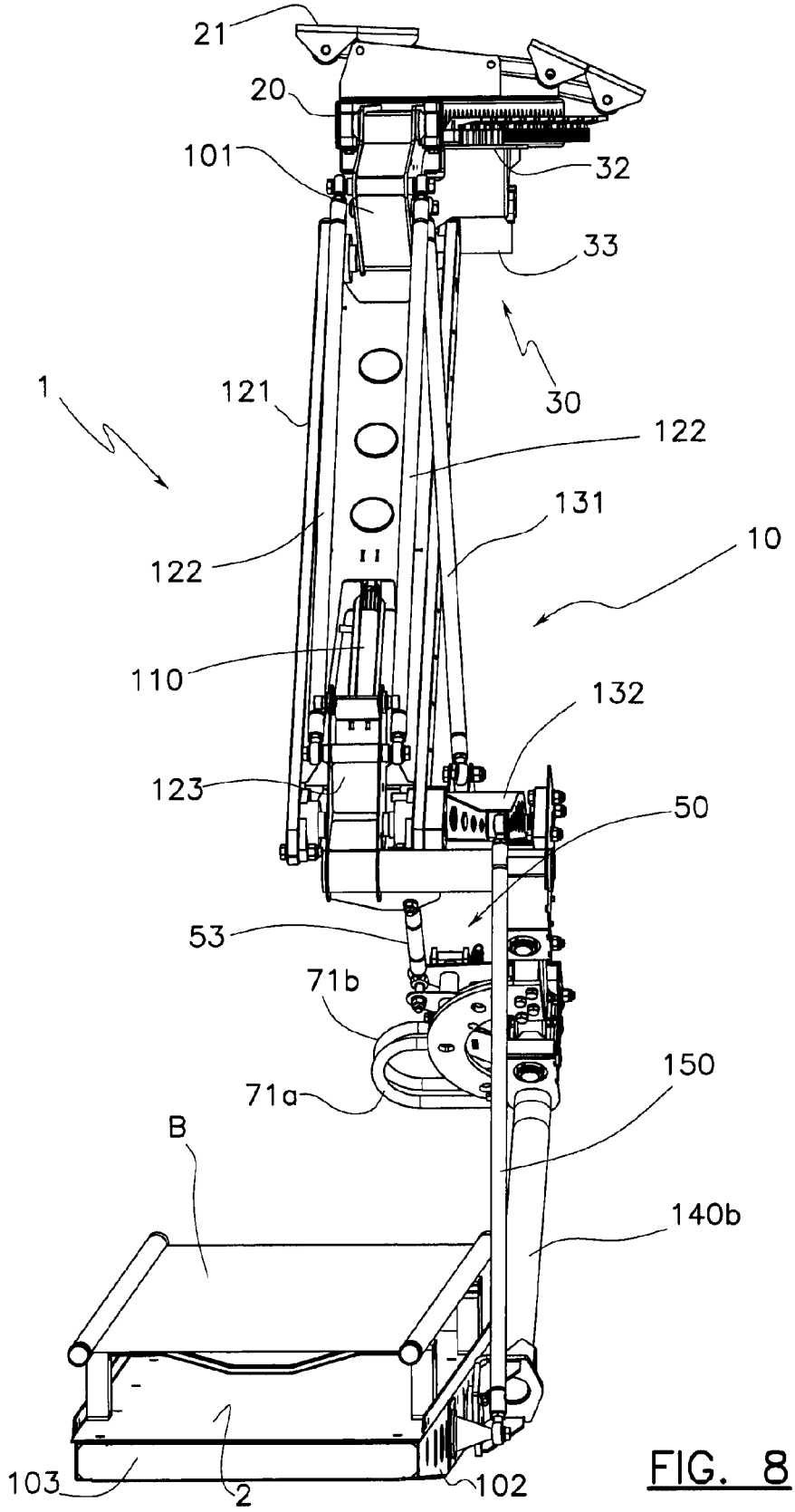
FIG. 8 is a rear elevation view of the lifting device of FIG. 7.
Figure 9:
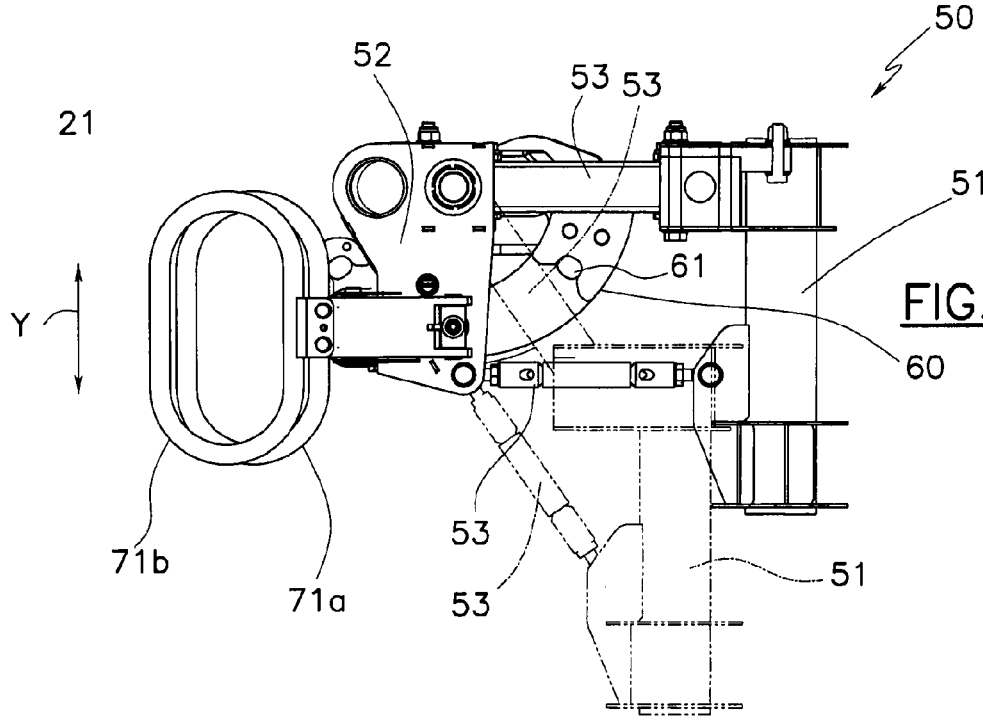
FIG. 9 is a view from above of the means for transversal displacement of the lifting device, according to the invention, with a broken line demonstrating the different operating configuration of the means for transversal displacement.
Figure 10:
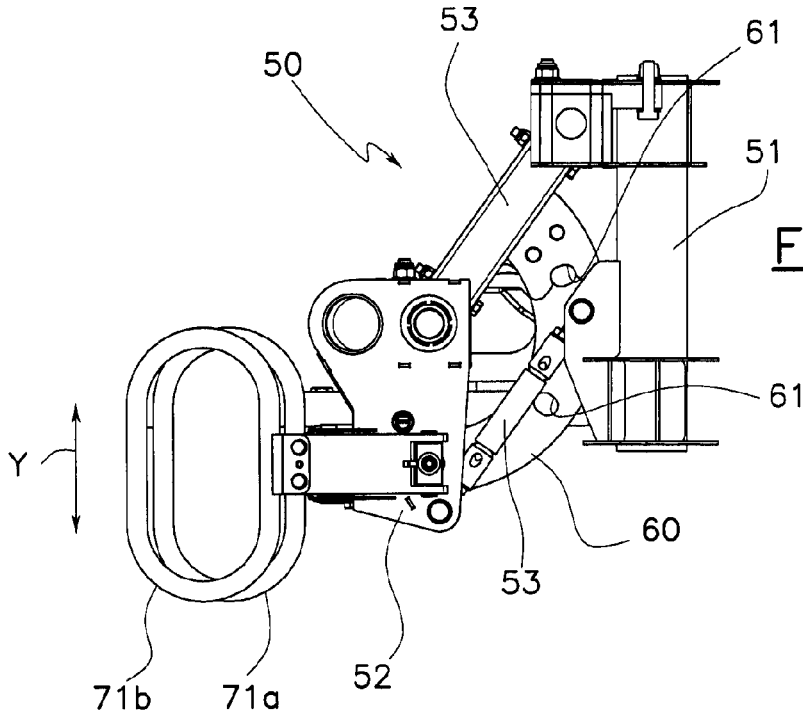
FIG. 10 is a view from above of the means for transversal displacement of the lifting device in a further different operating configuration thereof.

With particular reference to the figures, 201 denotes in its entirety an ambulance vehicle for transport of patients, the injured and the like.

The vehicle 201 comprises a sanitary compartment 202 in which a stretcher B can be rested, supporting a patient, for transport of the patient; the treading plane 203 of the sanitary compartment 202 is raised with respect to the ground 200.

The sanitary compartment 202 further comprises an access opening 204 to the compartment 202 which normally lies on a substantially vertical plane and is provided with closing elements such as doors or the like, not illustrated in the figures.

In the figures, 1 denotes a lifting device for loading and unloading a stretcher or the like, denoted overall by the letter B.

The stretcher B can be of any known type, either formed by a simple support table for the person or being equipped with a support frame provided with retractable legs and equipped with wheels.

The device 1 is associated to a vehicle 201 and, particularly, to the sanitary compartment 202 in which the stretcher B is rested, which stretcher B supports a patient for transport thereof.

In order to be loaded internally of the sanitary chamber 202, and unloaded therefrom, the stretcher B is alternatively located between a first extracted position in which it rests on the ground 200 by the vehicle, and a second housing position in which it is completely arranged internally of the sanitary compartment 202.

The device 1 comprises collecting means, which are destined to pick up the stretcher B, which are mobile between a lowered configuration, in which they are arranged at a lower height with respect to the height defined by the treading plane 203 in order to collect the stretcher B, and a raised configuration, in which they are arranged at a greater height to the height defined by the treading plane 203 in order to maintain the stretcher raised.

The collecting means comprise, in particular in the embodiment shown in the figures, a rest plane 2 for the stretcher B; alternatively, the collecting means can be different, for example they can be means which hook the stretcher B or exhibit guides for insertion and sliding of the stretcher.

The device 1 further comprises means for moving which are configured such as to move the collecting means between the lowered configuration and the raised configuration, and which are internally associated to the sanitary compartment 202, for moving the stretcher B between the first position and the second position.

In particular, the movement means are associated to an upper zone of the sanitary compartment 202, which zone is defined such as to be arranged superiorly of the collecting means 2.

By upper zone, what is principally meant is the upper wall 205 of the sanitary compartment 202, which is opposite the treading plane 203, and preferably at a halfway zone thereof; alternatively, however, the movement means could be fixed to one of the lateral walls 206, for example in proximity of the upper wall or both the lateral walls or even to a false-ceiling frame which might be present in the sanitary compartment, or in a non-central zone of the upper wall.

The movement means are, furthermore, destined to maintain the stretcher B raised, suspended at a distance from the treading plane 203, when the stretcher B has been collected from the collecting means.

The movement means advantageously comprise lifting means which lift the stretcher B, collected when in the first position, to a higher level than the level of the treading plane 203.

The movement means further comprise translating means for translating the stretcher B, once it has been raised by the lifting means, along a direction which is substantially parallel to the treading plane 203, and in particular a horizontal crossing direction X which is perpendicular to the access opening 204, i.e. a direction which is substantially parallel to the longitudinal axis of the sanitary chamber 202 in which the stretcher is housed.

The stretcher is also preferably arranged with the longitudinal axis substantially parallel to the longitudinal axis of the sanitary compartment.

The translating means, in particular, are destined to bring the stretcher B into the second above-mentioned position and the collecting means maintain the stretcher B in the raised position, substantially at the above-defined higher level, in the second position.

The upper level is defined such that the plane 2 with the stretcher B, resting thereon, remains suspended in the second position, above the treading plane 203.

The lifting means comprise at least an articulated system 10 comprising a fixed base 101 associated to the upper wall 205 and a mobile end 102 associated to the collecting means 2 and hinged thereto.

The lifting means further comprise a linear actuator 110 associated to the articulated system 10 for the movement of the mobile end 102 between a lowered configuration and a raised configuration of the collecting means 2.

The mobile end 102, in particular in the lowered configuration, is arranged at a lower height than the height defined by the treading plane 203.

In particular, and only by way of example, the mobile end 102 is positionable at a height of substantially 85 cm (or about) from the ground level, when the treading plane is at a height from the ground of substantially 150 cm; however the collecting means can be arranged at an even closer level to the ground, or even can be rested on the ground.

FIG. 1 illustrates a stretcher B of a type known as self-loading, i.e. a stretcher which comprises a rest table destined to support the patient in a supine position, to which legs are connected for supporting the stretcher on the ground. The legs are reclinable from an open position in which they support the rest table substantially at the same height as the plane 2, to a closed position, in which the support the rest table at a level that is close to the ground, in order to facilitate transfer of the injured person on the stretcher.

The support legs in the self-loading stretchers are generally reclinable independently of one another, such that during the loading and unloading stages of the stretcher from the ambulance, the operator can always avail of at least a support leg on which the weight of the stretcher B can be rested.

However, the invention is equally suitable for use for loading and unloading any type of stretcher B, and, indeed, directly for loading the patient or injured person resting directly on the plane 2.

In the other figures, the stretcher B is illustrated in a configuration with legs completely folded against the rest table; i.e. it functions as a simple stretcher without legs.

The mobile end 102 of the articulated system substantially exhibits the form of a substantially rectangular shape destined to support the plane in turn destined to restingly receive the stretcher B and is arranged with the larger sides substantially parallel to the horizontal crossing direction X.

The upper height is particularly defined such that the mobile end 102 also supports the plane 2 and the stretcher B, in the second position, is suspended from the treading plane 203.

The articulated system 10 comprises, for example, at least a four-bar linkage. In the preferred embodiment shown in the figures, the articulated system 10 comprises a first four-bar linkage formed by the fixed base 101, to which a first lever 121 and a first tie-bar 122 are hinged.

The first lever 121 and the first tie-bar 122 are in turn hinged to a first rocker arm 123.

The actuator 110 can be interposed between the first rocker arm 123 and at least one from among the first lever 121 and the first tie-bar 122, for rotating the first lever 121 with respect to the base 101.

In the example reported in the figures, the actuator 110 comprises a hydraulic or pneumatic jack, the body 111 of which is hinged to the first lever 121 and the stem 112 of which is hinged to the first rocker arm 123.

The actuator 110 is double-acting, i.e. such as to extend and retract actively with the aim of motorising both the lowering and the raising of the mobile end 102 and, therefore, the collecting means 2.

The stem run 112, in the two directions with respect to the body 111 of the jack, is such as to define the arc described by the first lever in order to bring the collecting means from the lowered configured to the raised configuration and vice versa.

In particular, the first four-bar linkage comprises a pair of first tie-bars 122 which are parallel to one another.

The articulated system 10 further comprises a second four-bar linkage in turn formed by the same fixed base 101, the first lever 121, a second tie-bar 131, hinged to the base 101 and a second rocker arm 132, which is in turn hinged to the second tie-bar and the first lever 121.

The second four-bar linkage is moved by the same actuator 110 and the first rocker arm 123 and the second rocker arm 132 counter-rotate.

The first rocker arm 123 and the second rocker arm 132 are advantageously hinged to the first lever 121 for rotation with respect to a single rotation axis.

The articulated system 10 further comprises a third lever 140 solidly associated to the first rocker arm 123 and hinged in turn to a first portion 102*a* of the mobile end 102.

The first portion 102*a* is substantially defined close to the sanitary compartment 202, i.e. it is a portion of the rectangular plate arranged on one of the larger sides thereof and interposed between the proximal end to the sanitary chamber 202 of the plate and the halfway line of the larger side.

Finally, the articulated system 10 comprises a third tie-bar 150 associate rotatably to the second rocker arm 132 with respect to an eccentric hinging axis with respect to the hinge points of the first lever 121 and the second tie-bar 131 to the second rocker arm.

The third tie-bar 150 is further rotatably associated to a second portion 102*b* of the mobile end 102 substantially distanced from the first portion 102*a* for maintaining the mobile end 102 in a substantially horizontal position during the movement between the lowered configuration and the raised configuration of the collecting means.

In particular, the second portion 102*b* is substantially distant from the sanitary chamber 202, i.e. it is a portion of the rectangular plate arranged on the same larger side thereof to which the third lever 140 is hinged, and interposed between the distal end of the sanitary chamber 202 of the plate and the half-way point of the larger side.

Thus the third lever 140 and the third tie-bar 150 are associated to the mobile end 102 by a single side thereof, in particular at one of the larger sides, the other larger side remaining free for access of the stretcher B resting on the plane 2.

The articulated system 10 in particular is such as to define a trajectory to the plane 2 which is such that it is arranged substantially horizontal at the positioning of the mobile end 102 in the raised configuration and substantially horizontal or slightly inclined with respect to the horizontal, for example a defined introduction angle, on positioning of the mobile end 102 in the lowered configuration.

The eventual inclination of the plane 2 in the lowered configuration facilitates the loading operations of the stretcher B on the plane 2. The introduction zone of the head of the stretcher, i.e. the distal end from the treading plane 203, remains at a slightly lower height than the end thereof which is proximal to the treading plane, facilitating access of the stretcher B to the plane 2.

Further, the above-described articulated system 10, thanks to the lowering of the first lever 121 by action of the actuator 110, enables the plane 2 to descend below the height of the treading plane 203 and the contemporary displacement of the plane 2 along the horizontal crossing direction X in the distancing direction from the sanitary compartment 202 of the plane 2.

The translation means advantageously comprise at least a straight guide 20 which is associated to the upper wall 205, for example fixed thereto by means of fixing organs such as appropriately-shaped brackets 21 destined to be bolted or in any case fastened to the upper wall 205, as known to an expert in the sector.

The straight guide 20 is conformed such as to extend along a substantially parallel direction to the horizontal crossing direction X, along the whole longitudinal development of the sanitary compartment 202.

However different positioning of the straight guide 20 internally of the sanitary compartment is possible, in which for example the straight guide itself is arranged with the longitudinal axis substantially inclined with respect to the horizontal crossing direction X.

The base 101 of the articulated system 10 is slidably associated to the straight guide 20, i.e. the base comprises a sliding skate such as to engage the system 10 in translation along the longitudinal axis thereof.

The translation means further comprise motor means 30 associated to the base 101 for translation thereof along the straight guide 20.

The motor means 30 comprise a rack 31 fixed and solidly associated to the straight guide 20 and developing over the whole length thereof.

Further, the motor means 30 comprise a cog wheel 32 keyed on the drive shaft of a motor 33, for example a hydraulic or electric motor or the like, fixed to the base 101 and destined to set the cog wheel 32 in rotation in both directions.

The cog wheel enmeshes with the rack 31 in order to translate the base along the straight guide 20.

The motor 33, like the actuator 110, is electrically supplied by an energy source, such as for example a battery associated to the vehicle 201; further, it is controlled by manual command means (not illustrated) which can comprise a keyboard or a lever or the like, activatable by an operator dedicated to loading and unloading operations of the stretcher B.

The device 1 further comprises a further guide formed by a channel 40 arranged with a longitudinal axis substantially parallel to the longitudinal axis of the straight guide 20 and such as to be engaged by a sliding pin 41, which pin 41 is solidly associated to the first rocker arm 123; however it could be associated to any other member of the first or second bar linkage.

The pin 41 is such as to slide restingly along the channel 40 it enters during the run of the base 101 along the straight guide 20, for auxiliary support of the articulated system 10 in the second position of the stretcher B with the collecting means in the raised configuration.

The device 1 advantageously comprises means for transversal displacement along a transversal direction Y defined substantially perpendicular to the horizontal crossing direction X set by the straight guide 20 of the stretcher B on a substantially horizontal plane.

The displacing means comprise at least a joint 50 associated to the third lever 140.

The third lever 140 comprises a first tract 140*a* associated solidly to the first rocker arm 123 and a second tract 140*b* hinged to the mobile end 102.

The joint 50 is interposed between the first tract 140*a* and the second tract 140*b* for rotation of the second tract with respect to the first tract, and with respect to a substantially vertical axis.

The joint 50 advantageously comprises a further four-bar linkage having a fixed limb 51 solidly associated to the first tract 140*a*, a mobile limb 52 associated to the second tract 140*b*, and a pair of con rods 53 interposed between the fixed limb 51 and the mobile limb 52.

The further four-bar linkage is advantageously in the example one for symmetrical movement of the second tract 140*b* with respect to the first tract 14*a*.

The device 1 further comprises regulating means of the reciprocal angular position between the first tract 140*a* and the second tract 140*b* of the third lever 140.

In more detail, the regulating means comprise at least a telescopic guide 60, ends of which are respectively associated, for example rotatably, to at least one of the con rods 53 and at least one of the fixed flap 51, the mobile flap 52 and the mobile limb 53 of the joint 50.

The telescopic guide 60 comprises holes 61 for blocking the telescopic portions of the guide 60 which are destined to be engaged by a bolt 70.

The bolt 70 is associated to the mobile limb 52 for blocking rotation between the second tract 140*b* and the first tract 140*a*.

In the particular embodiment, the telescopic guide 60 has a longitudinal axis, is substantially circular and the holes 61 are equidistanced along arcs of circumference.

The bolt 70 comprises a pair of jaws 71*a*, 71*b* for activating the bolt 70 which can be gripped and can be neared to one another.

A first jaw 71*a* is fixed and solidly associated to the second tract 140*b* and the second jaw 71 b is hinged thereto and supports the bolt 70.

The reciprocal nearing between the jaws 71 a, 71 b, in contrast with an elastic return element, such as a spring or the like, is such as to disengage the bolt 70 from the hole 61 of the telescopic guide 60.

The bolt 70 then engages the telescopic guide 60, for example substantially by swinging, during the movement of the second tract 140*b* with respect to the first tract 140*a* in order to engage in a further hole 61 of the telescopic guide 60 and blocking the reciprocal position between the first and the second tracts.

The functioning of the device 1, according to the invention, is the following.

In order to perform the loading operations of a stretcher B, located in the first extracted position, the motor 33 is activated to translate the base 101 along the straight guide 20 in order to bring the collecting means 2 externally of the sanitary compartment 202.

At this point, the collecting means 2 are lowered by activating the actuator 110, which causes the first lever 121 to oscillate with respect to the base 101 and lower it and, with it, the third lever 140 supporting the mobile end 102.

The oscillation of the first rocker arm 123 contemporaneously enables rotation of the third lever 140, the end of which hinged to the mobile end 102 distances from the treading plane 203 (along the crossing direction X).

At the same time, the second rocker arm 132 counter-rotates with respect to the first rocker arm 123 and maintains the third tie-bar 150 in traction such as to keep the second portion 102*b* of the end 102 lowered and, in particular, bring it to a lower height with respect to the height of the first portion 102, determined by the desired entry angle defined.

In the lowered configuration of the collecting means 2, the stretcher can be arranged on the plane 2, for example, if the stretcher is of a type comprising retractable legs, with the simple pushing of the stretcher onto the plane 2, which arranges the stretcher on the collecting means and retracts the legs at the same time.

To pass from the lowered configuration to the raised configuration, the actuator 110 is activated in an opposite direction to that for the lowering of the collecting means 2, i.e. it actively extends.

Once the collecting means 2 have been returned into the raised configuration, the motor 33 direction is inverted in order to return the collecting means 2, with the stretcher loaded thereon, to rest substantially horizontally internally of the sanitary compartment 202; therefore the stretcher can be positioned in the second position.

In this position the stretcher B can be laterally displaced in the two directions along direction Y, in order to near it to one of the lateral walls 206 of the sanitary compartment 202 by acting on the joint 50.

Practically, it is sufficient to disengage the bolt 70 from the hole 61 by gripping the jaws 71*a*, 71*b* and moving the mobile limb 52 to the desired side. The bolt 70 will return to engage the hole 61 in order to block the joint 50 in the newly-reached position.

To unload the loaded stretcher, it is sufficient to reverse the loading stages as described above.

The lifting device enables the stretcher and therefore the patient, during the stages of transport internally of the sanitary compartment, to be suspended away from the bottom of the compartment and thus the safety of the patient is ensured against any deformations which the bottom and the lateral walls might suffer pursuant to explosions affecting the transport vehicle.

Further, the device of the invention has the advantage of reducing the possibility that any deformations of the sanitary compartment involving the treading plane or the lateral walls thereof, for the above-mentioned reasons, cause damage to the device itself.

Of no lesser importance is the fact that the device enables gripping the stretcher from above and raising it with the advantages as set out above, while at the same time there is good control over the stages of loading and unloading performed by the medical personnel involved.

This technical specification not only enables the lowering and raising of the stretcher respectively onto and off the ground, facilitating the operations of the medical personnel during the stages of loading and unloading, but also enables the collecting means and therefore the stretcher to be picked up and guided solidly, and maintained substantially horizontal during the raising and lowering stages.

Furthermore, the described articulated system of the collecting means enables the collecting means to move in two degrees of freedom, controlled and guided by mechanisms which enable a high degree of stability and at the same time enable movement trajectories of the collecting means which are particularly easy to control for the sanitary personnel dedicated to the loading and unloading of the patient and such as to guarantee the safety of the patient, as well as to facilitate the loading of the stretcher on the collecting means.

Further, when the stretcher is substantially raised from the ground and stably associated to the collecting means and arranged internally of the sanitary compartment, with the invention the stretcher can be transferred laterally in order to facilitate the passage of the sanitary personnel either for imparting first aid on the patient, which can also be done during the stage of transport thereof, with the aim of distancing the loaded stretcher from any deformed zones of the sanitary compartment of the vehicle.

Further, the blocking of the desired positioning of the loaded stretcher on the collecting means internally of the sanitary compartment is guaranteed by the regulating means, which further enable regulating the distance of the stretcher from the lateral walls of the sanitary compartment.

Finally, the vehicle provided with the device of the invention exhibits the advantage that beyond facilitating the loading and unloading operations of the stretcher into and out of the sanitary compartment, it enables the patient to be protected from any accidents, such as detonations or the like, which cause the deformation of the sanitary compartment, especially the walls of the compartment most subject to the deformations, such as the bottom and the lateral walls.

The invention as conceived is susceptible to numerous modifications and variants, all falling within the ambit of the inventive concept.

Further, all the details can be substituted by other technically equivalent elements.

In practice, the materials used as well as the contingent shapes and dimensions can be of any type according to requirements, without its forsaking the ambit of protection of the following claims.

The invention claimed is:

1. A vehicle (201) for transport of injured persons or patients the vehicle (201) comprising:

a sanitary compartment (202) comprising a treading plane (203) raised with respect to a ground (200) surface, and an upper zone proximate to and below an upper wall (205), opposite the treading plane (203);

a lifting device (1) for loading and unloading a stretcher located between a first extracted position in which the stretcher (B) is resting on the ground (200) and a second housed position in which the stretcher is arranged internally of the sanitary compartment (202), the lifting device (1) comprises:

collecting means (2) configured to pick up the stretcher (B);

movement means (10, 20, 30) of the collecting means (2), internally linked to the sanitary compartment for moving the stretcher (B) between the first position and the second position; wherein the movement means (10, 20, 30) comprise lift means (10) to lift the collecting means (2) together with the collected stretcher from the first position to a level higher than a height of the treading plane (203) and translation means (20, 30) to translate the raised collecting means (2) together with the collected stretcher (B) for superposing the stretcher (B) above the treading plane, the lift means (2) maintaining the stretcher (B) raised in the second position thereof, suspended above the treading plane (203), at a distance therefrom, during the stage of transport of the patient, the movement means (10, 20, 30) being connected to an upper zone of the sanitary compartment (202), arranged superiorly of the collecting means (2), and being configured to maintain the collected stretcher (B) in said second position.

2. The vehicle (201) of claim 1, wherein the movement means (10, 20, 30) are connected to the upper wall (205) of the sanitary compartment (202) opposite the treading plane (203) thereof.

3. The vehicle (201) of claim 1 wherein the movement means move along a substantially parallel direction to the treading plane (203) substantially at the higher level.

4. The vehicle (201) of claim 3, wherein the lift means comprise at least an articulated system (10) comprising a fixed base (101) connected to the upper wall (205) and a mobile end (102) associated to the collecting means (2) and a linear actuator (110) associated to the articulated system (10) for moving the mobile end (102) between a lowered configuration and a raised configuration of the collecting means (2).

5. The vehicle (201) of claim 4, wherein the articulated system (10) comprises:

a first four-bar linkage (101, 121, 122, 123) comprising the fixed base (101) to which are hinged a first lever (121) and a first tie-bar (122), both in turn hinged to a first rocker arm (123), the actuator (110) being interposed between the first rocker arm (123) and at least one of the first lever (121) and the first tie-bar (122) for rotating at least the first lever (121) with respect to the base (101);

a second four-bar linkage (101, 121, 131, 132) comprising the fixed base (101), the first lever (121), a second tie-bar (131) hinged to the base (101) and a second rocker arm (132), in turn hinged to the first lever and the second tie-bar (131);

a third lever (140), solidly associated to the first rocker arm (123) and in turn hinged to a first portion (102*a*) of the mobile end (102) and a third tie-bar (150) rotatably associated to the second rocker arm (132) and to a second portion (102*b*) of the mobile end (102) substantially distanced from the first portion (102*a*) in order to maintain the mobile end (102) in a substantially horizontal position during the movement between the lowered configuration and the raised configuration of the collecting means (2).

6. The vehicle (201) of claim 3 wherein the translating means comprise at least a straight guide (20) connected to the upper wall (205) and engageable by the base (101) for translation of the base, and motor means (30) connected to the base (101) for translation of the base (101) along the straight guide (20).

7. The vehicle (201) of claim 1, wherein the collecting means comprise a rest plane (2) for a stretcher (B).

8. The vehicle (201) of claim 1, wherein the lifting device (1) comprises means for transversally displacing (50) the stretcher (B) on a substantially horizontal plane.

9. The vehicle (201) of claim 5, wherein the means for displacing comprise a joint (50) connected to the third lever (140), the third lever (140) comprising a first tract (140*a*) solidly associated to the first rocker arm (123) and a second tract (140*b*) hinged to the mobile end (102), the joint (50) being interposed between the first tract (140*a*) and the second tract (140*b*) for rotation of the second tract (140*b*) in relation to the first tract (140*a*), with respect to a substantially vertical axis.

10. The vehicle (201) of claim 9, wherein the joint (50) comprises a four-bar linkage (51, 52, 53) having a fixed limb (51) connected to the first tract (140*a*), a mobile limb (52) connected to the second tract (140*b*) and a pair of con rods (53) interposed between the fixed limb (51) and the mobile limb (52).

11. The vehicle (201) of claim 9, wherein the lifting device (1) comprises regulating means (60, 70) of the reciprocal angular position of the first tract (140*a*) with respect to the second tract (140*b*) of the third lever (140).

12. The vehicle (201) of claim 10, wherein the regulating means comprise a telescopic guide (60), ends of which are respectively connected to at least one of the con rods (53) of the pair of con rods and at least one of the fixed limb (51) and the mobile limb (52), the telescopic guide (60) comprising holes (61) for blocking the telescopic portions of the telescopic guide (60), which holes (61) are configured to be engaged by a bolt (70) connected to the mobile limb (52) for halting rotation between the second tract (140*b*) and the first tract (140*a*).

* * * * *